United States Patent [19]

Rabe

[11] 4,027,187

[45] May 31, 1977

[54] SUPERSONIC SPARK GAP SWITCH

[75] Inventor: Douglas C. Rabe, Dayton, Ohio

[73] Assignee: The United States of America as represented by the Secretary of the Air Force, Washington, D.C.

[22] Filed: Apr. 22, 1976

[21] Appl. No.: 679,267

[52] U.S. Cl. ..... 313/217; 313/231; 313/325

[51] Int. Cl.[2] ..... H01J 17/04

[58] Field of Search ..... 313/231, 231.1, 231.2, 313/231.3, 231.4, 217, 325

[56] References Cited

OTHER PUBLICATIONS

"High Power Spark Gap Switch Development", published by the Air Force Aero Propulsion Laboratory, Air Force Systems Command, Wright–Patterson Air Force Base as technical report AFAPL–TR–75–41.

*Primary Examiner*—Rudolph V. Rolinec
*Assistant Examiner*—Darwin R. Hostetter
*Attorney, Agent, or Firm*—Joseph E. Rusz; Robert Kern Duncan

[57] ABSTRACT

The hot gases and discharge products are removed from the space between the electrodes of a spark gap switch after the passage of the discharge by a supersonic air flow in the discharge region created by fabricating the ends of the electrodes to form a DeLaval nozzle. The supersonic air flow clears the switch and provides a switch having a very short grace period.

3 Claims, 5 Drawing Figures

57
AIR SUPPLY SOURCE AND PRESSURE CONTROL
58
51
40
50
47
53
42
44
51
51
51
45
51
43
46
52
52
41
54
49
48
59
51

SUPERSONIC SPARK GAP SWITCH

RIGHTS OF THE GOVERNMENT

The invention described herein may be manufactured and used by or for the Government of the U.S. for all governmental purposes without the payment of any royalty.

BACKGROUND OF THE INVENTION

The field of the invention is in the spark gap switch art.

Spark gap switches are well known having been used in radar equipment for many years as T-R (Transmit-Receive) switches, and more recently in pulsed laser systems. The spark gap switch as referred to herein, and as generally referred to, is used only to initiate energy flow to a load from an electrical energy storage device, such as a capacitor bank or a pulse forming network. The average power is frequently in the multimegawatt range. The energy flows until most or all of the energy stored passes the gap. At this crucial time, the cessation of the passage of energy, it is desired to reapply energy to the energy storage device. However, energy cannot be immediately reapplied with the resultant voltage build-up across the gap without the gap rebreaking down or the gap by still having a relatively low resistance across its electrodes is prohibitive or at least detrimental to a voltage built-up. The gap must be cleared of hot gasses, plasmas, and other discharge products before the voltage can be started on its building back up to discharge potential. This time that must be allowed for the switch to recover its dielectric strength; i.e., regain open circuit characteristics, is commonly called the grace period of the switch. It is a particular object of this invention to provide a novel gap structure that will shorten the grace period of spark gap switches.

Some prior art high power spark gap switches have used an air flow to remove the discharge products generated by the conduction current and clear the gap. A recent publication, of unlimited distribution, entitled "High Power Spark Gap Switch Development", published by the Air Force Aero Propulsion Laboratory, Air Force Systems Command, Wright-Patterson Air Force Base, Ohio 45433 as technical report AFAPL-TR-75-41, discloses current state of the art spark gap switches using a flow of air to clear the gap after a conduction period.

The spark gap switches using a flow of air to clear the switch after cessation of the current pulse are not to be confused with gas-blast circuit breakers. These latter devices are also well known particularly in the high power electrical switch-gear field. In them, the flow of current that is continuing in the gap formed by opening the switch is interrupted by the air flow. Many electrical utility company switches are of this type. Generally, the spark gap switch is not a circuit breaker. To further aid in distinguishing these two at first seemingly allied devices, but actually entirely different in function and operation, reference is made to the following publications. A. J. Shrapnel and D. J. Siddons, "A Model for a Convection Dominated Arc", Second International Conference on Gas Discharge, London, Engl, Sept. 1972, IEE Conference Publication No. 90, pp 317–319; and Horst Kopplin et al, "Study of the Effects of Gas Flow in the Performance of Gas-Blast Circuit Breakers", Proceedings of the IEEE, Vol, 59, No. 4, April 1971, pp 518–524.

SUMMARY OF THE INVENTION

By shaping the electrodes of a spark gap switch in the form of a DeLaval nozzle, i.e., a converging diverging nozzle, and providing a flow of air through the gap such that a supersonic air flow exists in the discharge region of the gap an improved spark gap switch is provided that has approximately onehalf the grace period of a prior art spark gap switch of otherwise similar characteristics.

DESCRIPTION OF THE PREFERRED EMBODIMENT

Figure 1:
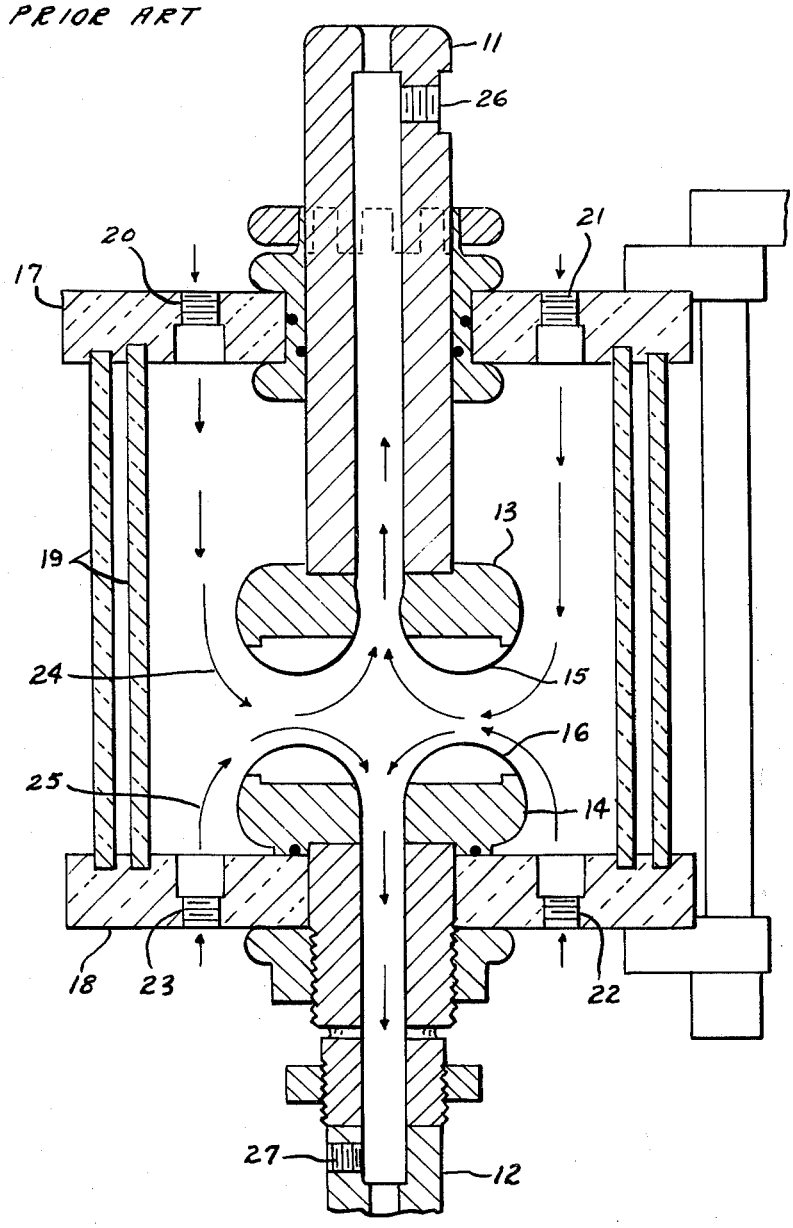
Fig-1 PRIOR ART
FIG. 1 is a representative sectional view of a typical prior art spark gap switch.

This invention is primarily concerned with the electrode tip structure defining the electrode gap, and the air flow therethrough, of a spark gap switch to provide an improved spark gap switch. The improvement is a shortening of the grace period of the switch. The remainder of the switch structural elements are of typical prior art design and are not critical to this invention. The prior art design is exemplified by FIGS. 1, 2, and 3. FIG. 1 shows in a sectional view of a typical 4-inch diameter electrode switch. Hollow cylindrical copper members 11 and 12 support copper doughnut-shaped electrodes 13 and 14, which have elkonite tip members 15 and 16. Insulating end members 17 and 18 support double polycarbonite wall 19 providing an enclosure for the spark gap and a means of mounting the switch assembly. Air under pressure is connected to fittings 20, 21, 22, and 23, providing an air flow 24 and 25 across the faces of the gap and out to ambient air through hollow copper cylindrical members 11 and 12. Conventional electrical connection to the switch is made through screw connections 26 and 27.

Figure 2:
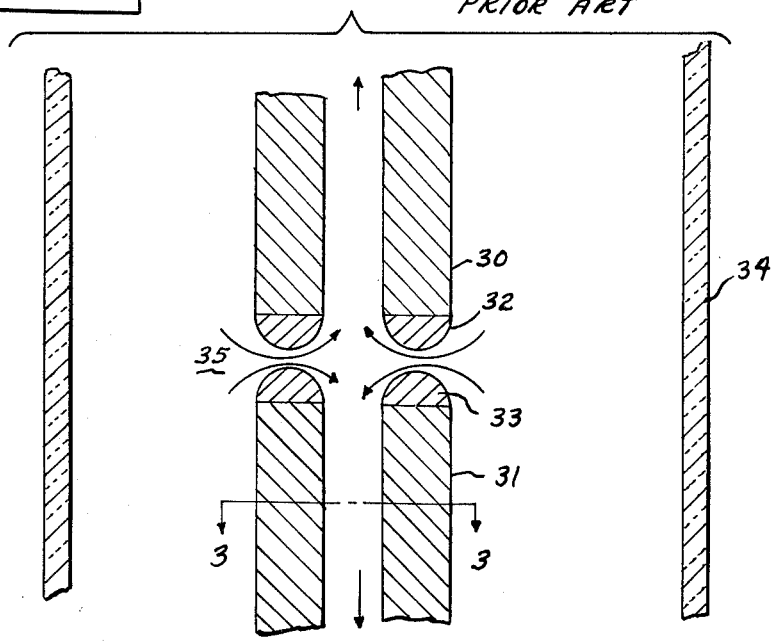
FIG. 2 is a simplified partial sectional view of another prior art spark gap switch having round-faced cylindrical electrodes.
Figure 3:
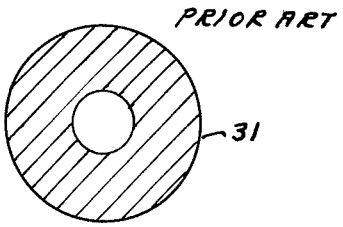
FIG. 3 is a sectional view through an electrode of the switch shown in FIG. 2.

Another prior art spark gap switch is shown in simplified schematic section in FIG. 2. Cylindrical electrodes 30 and 31 have elkonite tips 32 and 33. Switch wall 34 and end members (not shown) form the gas enclosure. Air flow 35, as in the previous device, flows across the electrode tip faces and out through hollow copper electrodes 30 and 31. FIG. 3 is a cross section view of hollow cylindrical electrode 31.

In these prior art devices for switching 200 to 500 millicoulombs of charge at pulse repetition rates of 100 to 500 pps, with hold-off voltages of approximately 20 Kv, and with air pressures of 20 to 50 psig and flow rates of approximately 100 CFM, typical grace periods required by the switches are from 600 to 1200 $\mu$ second.

Figure 4:
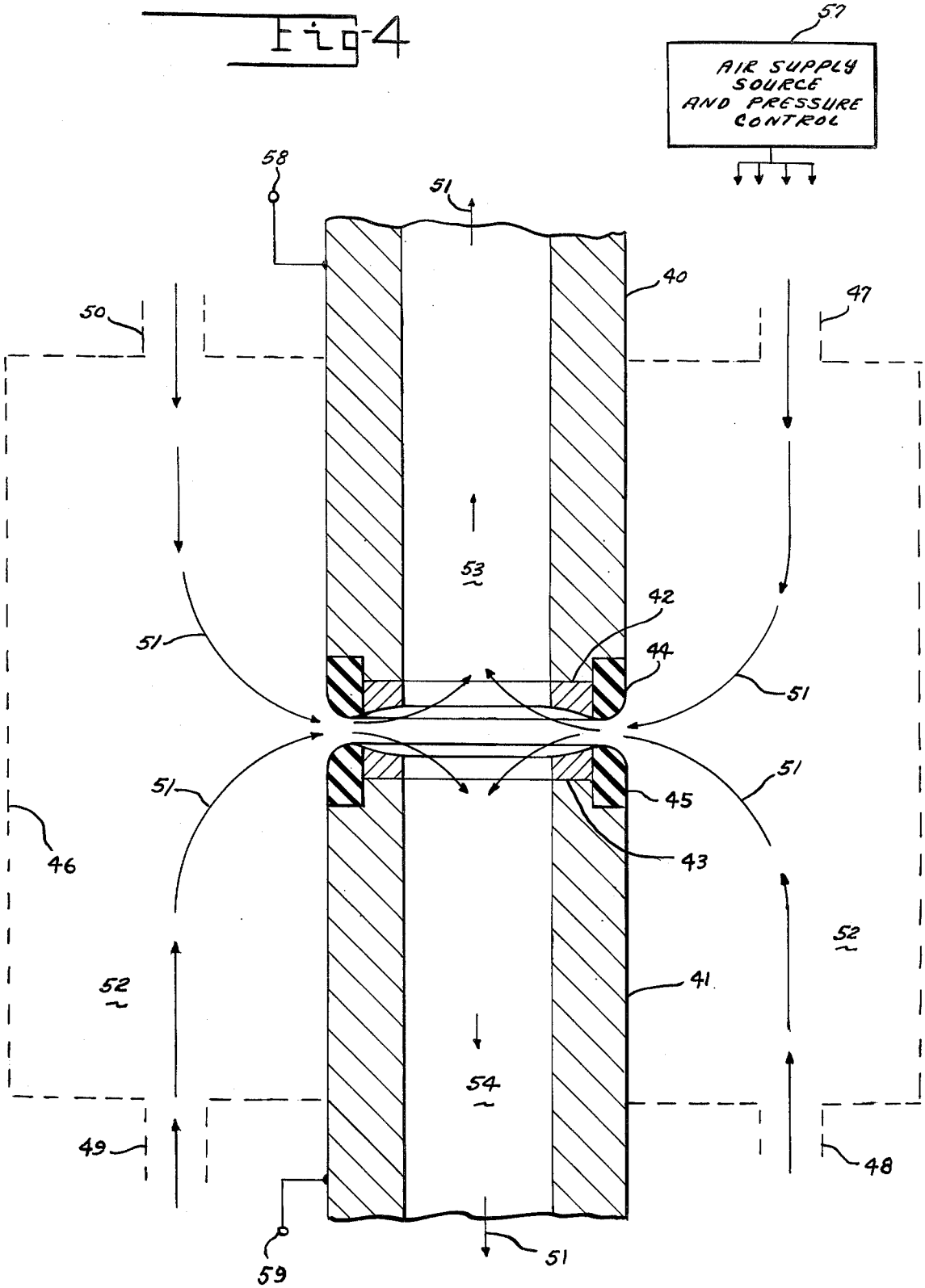
FIG. 4 is a schematic sectional view of an embodiment of the invention.

A typical embodiment of the invention is illustrated schematically in section in FIG. 4. Conventional hollow cylindrical copper electrode members 40 and 41 have insert elkonite tip members 42 and 43. It is between these elkonite tip members 42 and 43 that the electrical discharge takes place. It is to be understood that elkonite (tungsten-silver) is a generally preferred and conventional electrode tip material due to its excellent erosion characteristics. It is not a requirement of the invention. Tip sections 42 and 43 of the electrodes may be formed on the copper electrodes themselves, or from any other conventional arc resistant material such as platinum, rhodium, gold, silver, tungsten or alloys thereof. Electrode tips 42 and 43 are conventionally attached to electrode bodies 40 and 41 by welding. Also set in the faces of the electrodes are ring members 44 and 45, fabricated from conventional electrical insulation material such as mica, ceramic, and glazed steatite. Conventional ceramic type insulation epoxy bonded to the electrodes is generally preferred. The gap is conventionally enclosed by conventional insulative wall and end member 46 forming a closed air chamber. The shape of enclosure 46 is not critical. It must have at least one air inlet fitting for the flow of air. It has been found that four inlets on each side of the gap is generally preferable for uniform air flow. In FIG. 4, only four inlets 47, 48, 49, and 50, are representatively shown. Two more inlets at each end of the enclosure structure, diametrically opposite each other displaced ninety degrees from those shown are preferred to provide a relatively uniform distribution of air flow. A conventional air supply source 57 (which may be a pump supplying dry and filtered air, or bottled air tanks), including pressure control system and distribution header, connects with air inlet passages 47, 48, 49, and 50 of chamber 52.

Insulation ring members 44 and 45 and adjacent elkonite ring members 42 and 43 are shaped to form an annular DeLaval nozzle between the faces of the electrodes. Air flow 51 from enclosure chamber 52, as supplied from inlets 47, 48, 49, and 50, flows through the DeLaval nozzle at substantially subsonic velocity between insulative members 44 and 45, and at supersonic velocity through electrical discharge members 42 and 43. As better illustrated in the enlarged view of FIG. 5, generally it is desirable to extend insulative members 44 and 45 slightly past the throat of nozzle 55 into the start of expansion chamber 56 to ensure that all the discharge area of the gap is substantially in the supersonic air flow region. This slight amount of extension is not critical. It is quite desirable that the region of discharge be only in the supersonic flow region, thus the slight extension (from approximately 5% to approximately 20% of the expansion length is suitable), of the insulation into discharge region is desirable. The air pressure, and flow volume, provide supersonic air flow commencing in the throat of the nozzle and with a typical expansion of approximately 25% in the nozzle, the exit velocity is approximately Mach 1.5. Air flow 51 exhausts through hollow electrodes 40 and 41 to the ambient atmosphere.

Because of choking conditions in the throat of the gap, total cross section areas 53 and 54 for air flow within the two electrodes 40 and 41, must be greater than the throat area of the tubular nozzle. How much greater is determined by the heating and mass flow conditions of the particular embodiment; however, the throat of the gap must be choked. A value of total cross sectional flow area within the electrodes of approximately 50% greater than the throat area of the nozzle is generally suitable for typical spark gap switches.

It is desirable that the air flow through the nozzle forming the gap between the electrodes be continuous and not pulsed or extensively varied while the switch is operating. Since the geometry of the switch remains constant, the energy transfer must be triggered by an over voltage across the gap which, when of adequate magnitude, will break down the gap and energy transfer will result. Once most or all of the energy stored passes the gap, the supersonic air flow through the gap removes the residual plasma from the gap providing open circuit characteristics in approximately one-half the time of conventional gaps using subsonic air flow. This shortening of the grace period of the switch enables the energy to be reapplied to the energy storage element in a shorter time interval after discharge. Thus, the novel switch structure disclosed herein will provide for higher pulse repetition frequencies to be used by the apparatus with which it is associated. In many equipments, in addition to the conventional advantages of higher repetition rate, a more efficient utilization of the power source supplying the storage device may be realized due to the shorter no-load time on the supply.

Figure 5:
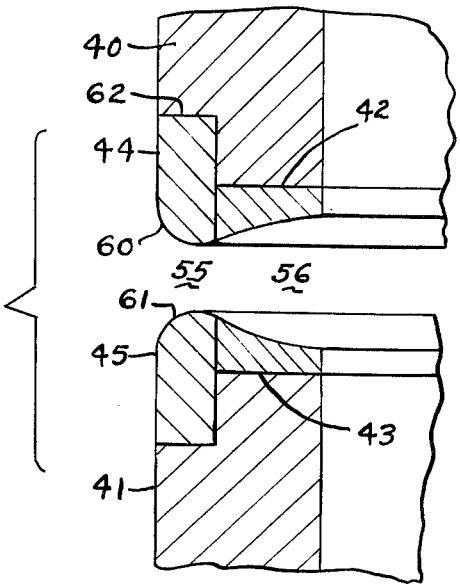
FIG. 5 is an enlarged view of a partial section of the electrode faces showing the nozzle structure formed at the electrode tips.

A specific typical embodiment of the invention as represented by the views of FIGS. 4 and 5 has cylindrical copper electrodes 40 and 41 having inside diameters of approximately 1.25 cm, and outside diameters of approximately 2.5 cm. Conventional electrical connections to the electrodes are schematically represented by connections 58 and 59. The width of throat 55 of the nozzle is approximately one-half cm and the width of the gap at the end of expansion chamber 56 of the nozzle is approximately 1 cm. The radii of curvatures 60 and 61 of insulators 44 and 45 forming the converging part of the nozzle are approximately one-fourth cm, and radial thickness 62 of insulating members 44 and 45 is approximately 0.45 cm. An air flow rate through the gap of approximately 570 CFM supplied by an enclosure inlet pressure of approximately 54 psia with an outlet pressure of approximately 14.7 psia provides the desired supersonic air flow through the gap. For this specific embodiment these values of air flow and pressures are considered minimum values to provide the supersonic flow. Moderately higher values may be used but generally the attendant complications of excessively higher values (doubled pressures and higher) out weigh the advantages. This switch under these conditions provides the following nominal characteristics of a hold-off voltage of 20 Kv, a charge transfer of 280 millicoulomb, and a grace period of approximately 350 $\mu$ seconds allowing for satisfactory pulse repetition rates in a particular system of 100 to 500 pps.

I claim:

1. The improvement in a spark gap switch having a first and a second hollow cylindrical electrode with means for connecting the said electrodes into an electrical circuit, with the said electrodes positioned in axial alignment with the electrode faces of the electrodes in spaced apart relationship providing an annular axial gap therebetween and with an air chamber enclosure connected to an air flow source surrounding the said gap and providing a flow of air through the said gap, the improvement in the said spark gap switch comprising:

a. the said annular axial gap between the said electrode faces being formed to comprise an annular DeLaval nozzle with the converging side of the nozzle adjacent the said air chamber and the expansion side of the nozzle exhausting into the said hollows of the said electrodes;

b. means for limiting the discharge region of the said gap to the expansion region of the said annular DeLaval nozzle; and c. means for providing a supersonic flow of air through the said expansion region of the said gap.

2. The improvement as claimed in claim 1 wherein the said means for limiting the discharge region of the gap to the expansion region of the said nozzle is an insulating ring positioned in each of the faces of the said electrodes in which the said converging region of the said nozzle is formed.

3. The improvement as claimed in claim 2 wherein the total of the cross section hollow areas of the said first and second hollow electrodes is greater than the throat area of the said annular DeLaval nozzle.

* * * * *